US007038564B1

(12) United States Patent
Kusumoto et al.

(10) Patent No.: US 7,038,564 B1
(45) Date of Patent: May 2, 2006

(54) ELECTROMAGNETIC STARTER SWITCH

(75) Inventors: Keiichi Kusumoto, Tokyo (JP); Hayato Yamauchi, Tokyo (JP); Motoaki Kimura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/125,251

(22) Filed: May 10, 2005

(30) Foreign Application Priority Data

Dec. 10, 2004 (JP) ..... 2004-358134

(51) Int. Cl.
*H01H 67/02* (2006.01)

(52) U.S. Cl. ..... 335/126; 335/131

(58) Field of Classification Search ..... 335/126, 335/131
See application file for complete search history.

(56) References Cited

U.S. PATENT DOCUMENTS 5,656,981 A * 8/1997 Niimi et al. ..... 335/126
5,909,067 A * 6/1999 Liadakis ..... 310/14
6,360,707 B1 * 3/2002 Boegner ..... 123/179.25
2002/0053961 A1 * 5/2002 Kajino ..... 335/126
2005/0190024 A1 * 9/2005 McMahon et al. ..... 335/126

FOREIGN PATENT DOCUMENTS

JP 7-109967 A 4/1995
JP 2004-190544 A 7/2004

* cited by examiner

*Primary Examiner*—Lincoln Donovan
(74) *Attorney, Agent, or Firm*—Sughrue Mion, PLLC

(57) ABSTRACT

An electromagnetic starter switch in which a voltage from a power source is depressed by a resistor and applied to a motor by an auxiliary movable contact coming into contact with a first auxiliary fixed contact and a second auxiliary fixed contact before a pinion gear intermeshes with a ring gear, and the voltage from the power source is subsequently applied to the motor without modification by the main movable contact also coming into contact with a first main fixed contact and a second main fixed contact after the pinion gear intermeshes with the ring gear, wherein: the first main fixed contact, the second main fixed contact, the first auxiliary fixed contact, and the second auxiliary fixed contact are disposed on a main switch cover.

4 Claims, 3 Drawing Sheets

ELECTROMAGNETIC STARTER SWITCH

BACKGROUND OF THE INVENTION

1. Field of the Invention

The present invention relates to an electromagnetic starter switch for starting an internal combustion engine by means of a pinion gear driven by a motor.

2. Description of the Related Art

Conventionally, in electromagnetic switches installed in auxiliary rotating starters, in order to control action of a motor during starting so as to be divided into two phases, there is provided: a main fixed contact; a main movable contact coming into contact with the main fixed contact; an auxiliary fixed contact; and an auxiliary movable contact coming into contact with the auxiliary fixed contact, and a resistor is installed in series in a circuit formed when the auxiliary movable contact comes into contact with the auxiliary fixed contact such that an electric current from a battery flows through this closed circuit to an armature of the motor, rotating the armature at low speed to engage a pinion fixed to a shaft of the motor into a ring gear smoothly.

Then, in a circuit formed when the main movable contact comes into contact with the main fixed contact, electric current from the battery flows through this closed circuit directly to the armature of the motor, and the motor rotates at a rated speed due to application of a rated voltage, starting an internal combustion engine. (See Patent Literature 1, for example.)

Patent Literature 1

Japanese Patent Laid-Open No. 2004-190544 (Gazette)

In an electromagnetic starter switch having the above configuration, because the main fixed contact is mounted to a main switch cover, and the auxiliary fixed contact is mounted to an auxiliary switch cover, one problem has been that the main switch cover and the auxiliary switch cover must each be mounted such that a fixed contact faces its respective movable contact, requiring a proportionate number of assembly man-hours.

SUMMARY OF THE INVENTION

The present invention aims to solve the above problems and an object of the present invention is to provide an electromagnetic starter switch enabling assembly man-hours to be reduced.

In order to achieve the above object, according to one aspect of the present invention, there is provided an electromagnetic starter switch including: a solenoid case; switch covers constituted by a main switch cover and an auxiliary switch cover, joined to a single side of an aperture portion of the solenoid case; a fixed core fixed inside the solenoid case; a main rod disposed inside the solenoid case and inside the switch covers so as to be able to reciprocate in an axial direction; a plunger that is contactable and separable relative to the fixed core, disposed so as to be slidable relative to the main rod; a first main fixed contact electrically connected to a motor, and a second main fixed contact electrically connected to a power source; a main movable contact disposed on the main rod so as to be contactable and separable relative to the first main fixed contact and the second main fixed contact; an auxiliary rod disposed so as to be coaxial with the main rod and capable of relative displacement; a coil fixed radially outside the fixed core such that when the coil is excited the coil moves the plunger in such a direction as to contact the fixed core; a first auxiliary fixed contact electrically connected to the first main fixed contact, and a second auxiliary fixed contact electrically connected to the second main fixed contact; a resistor disposed in at least one position selected from a position between the first main fixed contact and the first auxiliary fixed contact and a position between the second main fixed contact and the second auxiliary fixed contact; and an auxiliary movable contact disposed on the auxiliary rod so as to be contactable and separable relative to the first auxiliary fixed contact and the second auxiliary fixed contact, a voltage from the power source being depressed by the resistor and applied to the motor by the auxiliary movable contact coming into contact with the first auxiliary fixed contact and the second auxiliary fixed contact before a pinion gear intermeshes with a ring gear, and the voltage from the power source being subsequently applied to the motor without modification by the main movable contact also coming into contact with the first main fixed contact and the second main fixed contact after the pinion gear intermeshes with the ring gear, wherein: the first main fixed contact, the second main fixed contact, the first auxiliary fixed contact, and the second auxiliary fixed contact are disposed on the main switch cover.

Using an electromagnetic starter switch according to the present invention, assembly man-hours are reduced.

DETAILED DESCRIPTION OF THE PREFERRED EMBODIMENT

A preferred embodiment of the present invention will now be explained based on the drawings.

Embodiment 1

Figure 1:
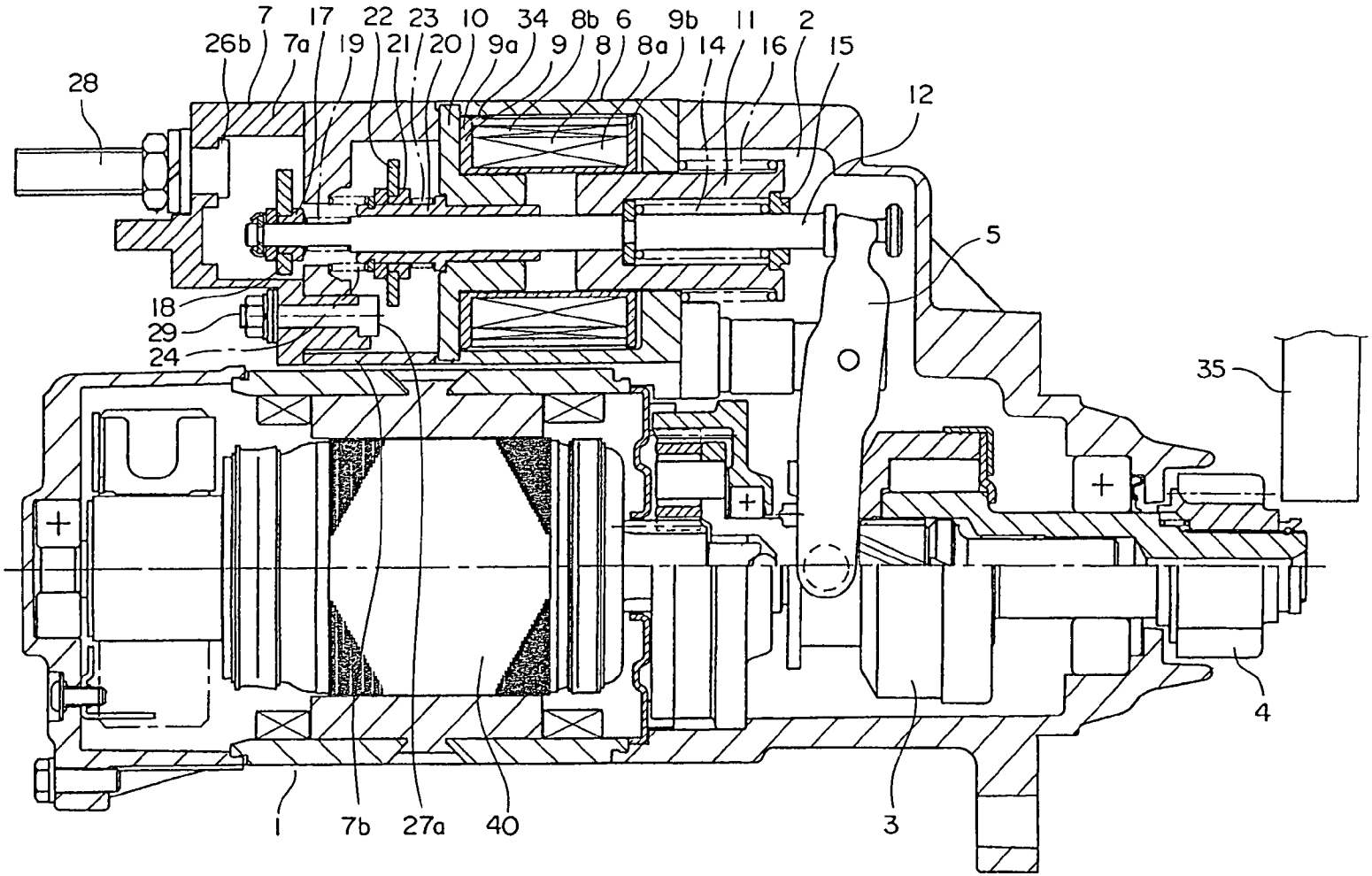
FIG. 1 is a cross section showing a starter in which an electromagnetic starter switch according to Embodiment 1 of the present invention is installed.
Figure 2:
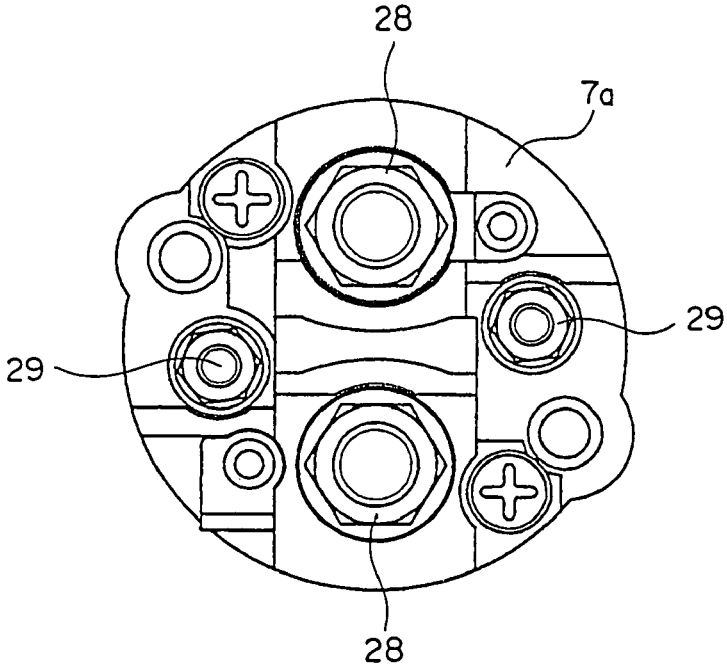
FIG. 2 is a diagram showing a main switch cover from FIG. 1 when viewed from a left side.
Figure 3:
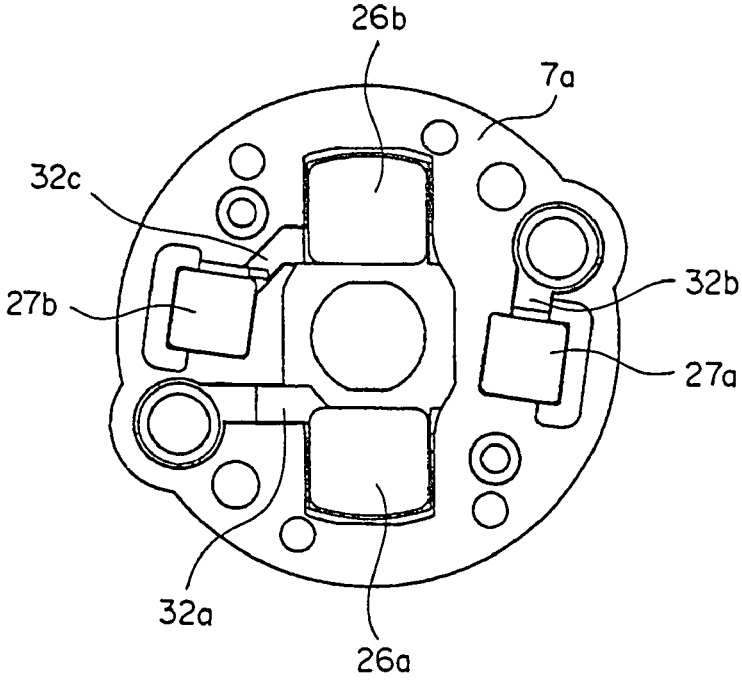
FIG. 3 is a rear end elevation of the main switch cover in FIG. 2.

FIG. 1 is a cross section showing a starter according to Embodiment 1 of the present invention, FIG. 2 is a diagram showing a main switch cover 7*a* from FIG. 1 when viewed from a left side, and FIG. 3 is a rear end elevation of the main switch cover 7*a* in FIG. 2.

This starter includes: a motor 1; an electromagnetic starter switch (hereinafter abbreviated to "electromagnetic switch") 2 switching on and off passage of electric current to the motor 1; a clutch 3 that is movable in an axial direction along a shaft of the motor 1; a pinion gear 4 linked to the clutch 3 and rotating with the clutch 3; and a lever 5 rotatably disposed between the electromagnetic switch 2 and the clutch 3.

In the electromagnetic switch 2, a switch cover 7 is connected to an opening portion of a cylindrical solenoid case 6.

A cylindrical bobbin 9 having first and second flanges 9*a* and 9*b* on two end portions is disposed inside the solenoid case 6. Coils 8 constituted by a primary coil 8*a*, and a secondary coil 8*b* disposed outside the primary coil 8*a*, are mounted to outer peripheral portions of the bobbin 9. A fixed core 10 is joined to a portion of an inner wall surface of the bobbin 9 and an outer surface of the first flange 9*a*.

A reciprocally slidable cylindrical plunger 11 is inserted inside the bobbin 9 in a region on the right in FIG. 1. A main rod 12 capable of relative displacement in an axial direction relative to the plunger 11 is disposed on an axis of the cylindrical plunger 11. A ring 15 that is slidable relative to the main rod 12 is fixed to an end portion of the plunger 11 near the lever 5. A lever spring 14 is disposed between the main rod 12 and the plunger 11. A portion of the plunger 11 on the right in FIG. 1 projects outside the solenoid case 6. A separating spring 16 that forces the plunger 11 in a direction that separates the plunger 11 from the fixed core 10 is disposed between an end portion of the plunger 11 and the solenoid case 6.

A first end portion of the lever 5 is rotatably disposed on a first end portion of the main rod 12. A main holding member 17 that is capable of reciprocating in an axial direction is disposed on an outer peripheral surface of a second end portion of the main rod 12. A main movable contact 18 is fixed to the main holding member 17. A main contact pressure spring 19 that forces the main movable contact 18 away from the plunger 11 is disposed between the main holding member 17 and a stepped portion of the main rod 12.

An auxiliary rod 20 having a cylindrical shape that is slidable in an axial direction relative to the main rod 12 is disposed on an outer peripheral surface of an intermediate portion of the main rod 12. An auxiliary holding member 21 that is capable of reciprocating in an axial direction is disposed on an outer peripheral surface of the auxiliary rod 20. An auxiliary movable contact 22 is fixed to the auxiliary holding member 21. A first auxiliary contact pressure spring 23 that forces the auxiliary movable contact 22 away from the plunger 11 is disposed between the auxiliary holding member 21 and a stepped portion of the auxiliary rod 20.

Switch covers 7 are constituted by a main switch cover 7*a* and an auxiliary switch cover 7*b*. A second auxiliary contact pressure spring 24 that forces the auxiliary movable contact 22 toward the plunger 11 is disposed between an inner radial portion of the auxiliary switch cover 7*b* and the auxiliary holding member 21.

A first main fixed contact 26*a* and a second main fixed contact 26*b* are mounted to the main switch cover 7*a* facing the main movable contact 18. A first auxiliary fixed contact 27*a* and a second auxiliary fixed contact 27*b* are also mounted to the main switch cover 7*a* facing the auxiliary movable contact 22. Main terminals 28 are disposed on the first main fixed contact 26*a* and the second main fixed contact 26*b*, respectively. Auxiliary terminals 29 are disposed on the first auxiliary fixed contact 27*a* and the second auxiliary fixed contact 27*b*, respectively.

Figure 4:
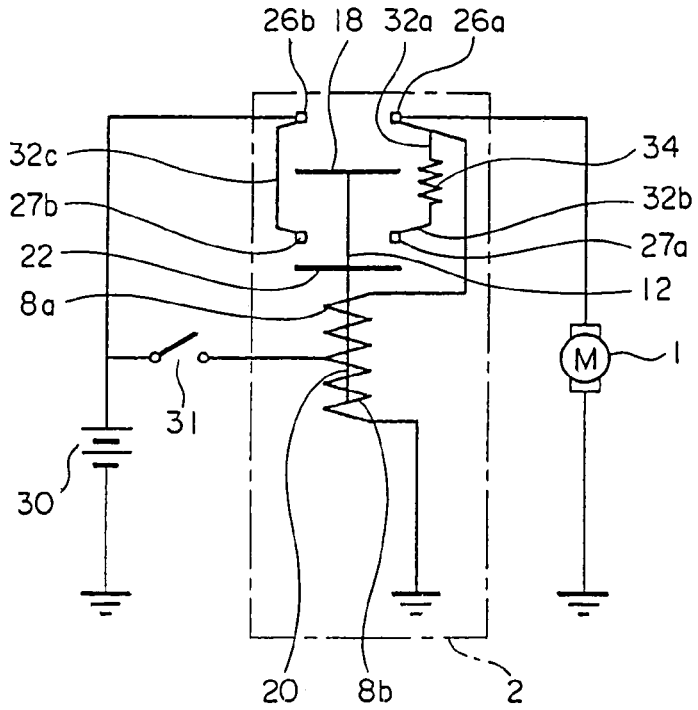
FIG. 4 is an electrical circuit diagram of the electromagnetic switch in FIG. 1.

FIG. 4 is an electrical circuit diagram of the electromagnetic switch shown in FIG. 1.

A battery 30 constituting a power source is electrically connected to the coils 8 of the electromagnetic switch 2 by means of a key switch 31. The primary coil 8*a* is connected to the first main fixed contact 26*a*. The first main fixed contact 26*a* is connected to a first end portion of a resistor 34 by means of a first connecting portion 32*a*. The resistor 34 has a zigzag shape, is composed of a copper-nickel alloy, and is affixed to an outer peripheral surface of the secondary coil 8*b* using an electrically-insulating tape. Moreover, the resistor 34 may also be affixed using an adhesive. A second end portion of the resistor 34 is connected to the first auxiliary fixed contact 27*a* by means of a second connecting portion 32*b*. The battery 30 is also connected to the second main fixed contact 26*b*. The second main fixed contact 26*b* is connected to the second auxiliary fixed contact 27*b* by means of a third connecting portion 32*c*.

Next, action of a starter having the above configuration will be explained.

When the key switch 31 is not closed, the plunger 11 is separated from the fixed core 10 by spring force from the separating spring 16, the main movable contact 18 is separated from the main fixed contacts 26*a* and 26*b*, and the auxiliary movable contact 22 is also separated from the auxiliary fixed contacts 27*a* and 27*b*. Because of this, electric current does not flow to the motor 1 from the battery 30.

When the key switch 31 is closed, the primary coil 8*a* and the secondary coil 8*b* are excited by passage of an electric current, the plunger 11 is attracted toward the fixed core 10, the main rod 12 and the auxiliary rod 20 also move together with the plunger 11 to the left in FIG. 1 against the elastic force of the separating spring 16, and the pinion gear 4 is pushed outward by means of the lever 5 such that side and end surfaces come into contact with a ring gear 35.

At this point in time, first the auxiliary movable contact 22 comes into contact with the auxiliary fixed contacts 27*a* and 27*b*, whereby the rated voltage of the battery 30 is depressed by the resistor 34 and is applied to the motor 1, and the armature 40 of the motor 1 begins rotation at low speed. The rotation of the armature 40 is transmitted to the pinion gear 4 by means of the clutch 3. At this time, because the rotational torque from the motor 1 and the voltage of the battery 30 are depressed by the resistor 34, the locking torque of the motor 1 at the instant when the pinion gear 4 and the ring gear 35 intermesh with each other is minimized, reducing impact force during intermeshing.

In addition, as the plunger 11 is attracted toward the fixed core 10, the pinion gear 4 reliably intermeshes with the ring gear 35, and first and second end portions of the main movable contact 18 come into contact with the first main fixed contact 26*a* and the second main fixed contact 26*b*, respectively. Here, because the resistor 34 is interposed in the circuit for the auxiliary movable contact 22, very little electric current flows through this circuit, the rated voltage of the battery 30 is applied to the motor 1 directly, and the motor 1 rotates at its rated speed due to application of the rated voltage, starting an internal combustion engine.

When the key switch 31 is released, passage of electric current to the primary coil 8*a* and the secondary coil 8*b* is cut off, the plunger 11 is separated from the fixed core 10 by the spring force from the separating spring 16, the main movable contact 18 is separated from the main fixed contacts 26*a* and 26*b*, and the auxiliary movable contact 22 is also separated from the auxiliary fixed contacts 27*a* and 27*b*, cutting off the passage of electric current to the motor 1. At the same time, the lever 5 linked to the main rod 12 pivots, releasing intermeshing between the pinion gear 4 and the ring gear 35.

In an electromagnetic switch having the above configuration, because the first main fixed contact 26*a*, the second main fixed contact 26*b*, the first auxiliary fixed contact 27*a*, and the second auxiliary fixed contact 27*b* are disposed on the main switch cover 7*a*, positioning relative to the respective movable contacts 18 and 22 need only be performed once, enabling assembly man-hours to be reduced.

Because the terminals 28 and 29 electrically connected to each of the first main fixed contact 26*a*, the second main fixed contact 26*b*, the first auxiliary fixed contact 27*a*, and the second auxiliary fixed contact 27*b* project outward from the switch covers 7 in an identical direction parallel to the axial direction of the main rod 12, workability when connecting each of the terminals 28 and 29 and external components is improved.

Because the first connecting portion 32*a* connecting the first main fixed contact 26*a* and the resistor 34, the second connecting portion 32*b* connecting the resistor 34 and the first auxiliary fixed contact 27*a*, the third connecting portion 32*c* connecting the second main fixed contact 26*b* and the second auxiliary fixed contact 27*b* are disposed inside the main switch cover 7*a*, short-circuiting is prevented between each of the connecting portions 32*a*, 32*b*, and 32*c* and external components disposed outside the main switch cover 7*a*.

Because the resistor 34 is disposed on an outer peripheral surface of the tubular coils 8, the resistor 34 can be affixed to and held on the coils 8 simply using an electrically-insulating tape, for example.

Figure 5:
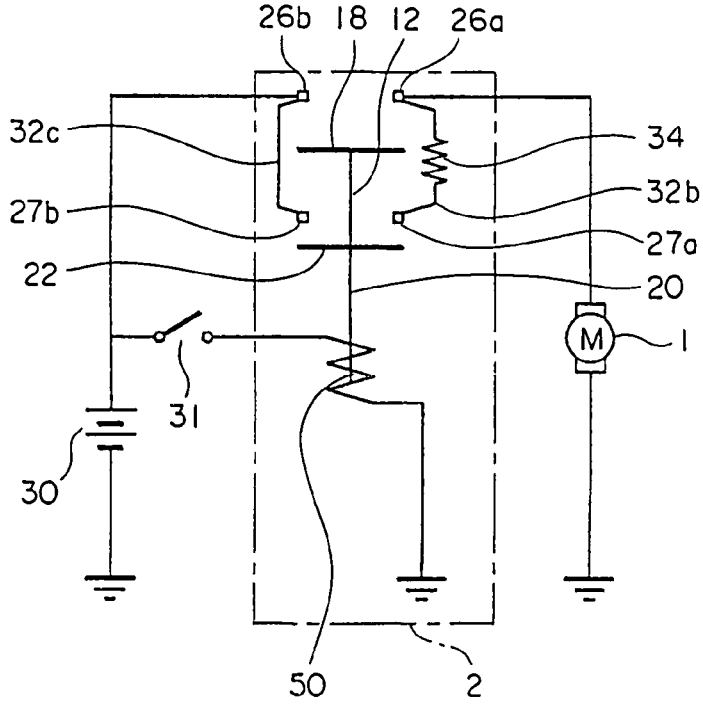
FIG. 5 is an electrical circuit diagram of an example of an electromagnetic switch that differs from the electromagnetic switch in FIG. 1.

Moreover, in the above embodiment, an electromagnetic switch has been explained in which coils 8 are constituted by a primary coil 8*a* and a secondary coil 8*b*, but of course the present invention can also be applied to configurations in which coils 50 are not separated into a primary coil and a secondary coil, such as that shown in FIG. 5.

In the above embodiment, an electromagnetic switch has been explained in which a resistor 34 is connected between a first main fixed contact 26*a* and a first auxiliary fixed contact 27*a*, but the present invention can also be applied to electromagnetic switches in which a resistor is disposed between a second main fixed contact 26*b* and a second auxiliary fixed contact 27*b*, or in which resistors are disposed both between a first main fixed contact 26*a* and a first auxiliary fixed contact 27*a* and between a second main fixed contact 26*b* and a second auxiliary fixed contact 27*b*.

What is claimed is:

1. An electromagnetic starter switch for starting an internal combustion engine by means of a pinion gear driven by a motor intermeshing with a ring gear, said electromagnetic starter switch comprising:

a solenoid case;

switch covers constituted by a main switch cover and an auxiliary switch cover, joined to a single side of an aperture portion of said solenoid case;

a fixed core fixed inside said solenoid case;

a main rod disposed inside said solenoid case and inside said switch covers so as to be able to reciprocate in an axial direction;

a plunger that is contactable and separable relative to said fixed core, disposed so as to be slidable relative to said main rod;

a first main fixed contact electrically connected to said motor, and a second main fixed contact electrically connected to a power source;

a main movable contact disposed on said main rod so as to be contactable and separable relative to said first main fixed contact and said second main fixed contact;

an auxiliary rod disposed so as to be coaxial with said main rod and capable of relative displacement;

a coil fixed radially outside said fixed core such that when said coil is excited said coil moves said plunger in such a direction as to contact said fixed core;

a first auxiliary fixed contact electrically connected to said first main fixed contact, and a second auxiliary fixed contact electrically connected to said second main fixed contact;

a resistor disposed in at least one position selected from a position between said first main fixed contact and said first auxiliary fixed contact and a position between said second main fixed contact and said second auxiliary fixed contact; and an auxiliary movable contact disposed on said auxiliary rod so as to be contactable and separable relative to said first auxiliary fixed contact and said second auxiliary fixed contact, a voltage from said power source being depressed by said resistor and applied to said motor by said auxiliary movable contact coming into contact with said first auxiliary fixed contact and said second auxiliary fixed contact before said pinion gear intermeshes with said ring gear, and said voltage from said power source being subsequently applied to said motor without modification by said main movable contact also coming into contact with said first main fixed contact and said second main fixed contact after said pinion gear intermeshes with said ring gear, wherein:

said first main fixed contact, said second main fixed contact, said first auxiliary fixed contact, and said second auxiliary fixed contact are disposed on said main switch cover.

2. The electromagnetic starter switch according to claim 1, wherein:

main terminals electrically connected to said first main fixed contact and said second main fixed contact, respectively, and auxiliary terminals electrically connected to said first auxiliary fixed contact and said second auxiliary fixed contact, respectively, each project outward from said main switch cover in an identical direction parallel to an axial direction of said main rod.

3. The electromagnetic starter switch according to claim 1, wherein:

a first connecting portion connecting said first main fixed contact or said second main fixed contact and said resistor, a second connecting portion connecting said resistor and said first auxiliary fixed contact or said second auxiliary fixed contact, and a third connecting portion connecting said first main fixed contact and said first auxiliary fixed contact or said second main fixed contact and said second auxiliary fixed contact are disposed inside said main switch cover.

4. The electromagnetic starter switch according to claim 1, wherein:

said coils have a tubular shape; and said resistor is disposed on an outer peripheral surface of said coils.

* * * * *